US010961749B2

(12) United States Patent
Akagi et al.

(10) Patent No.: US 10,961,749 B2
(45) Date of Patent: Mar. 30, 2021

(54) DOOR LOCKING DEVICE

(71) Applicant: U-SHIN LTD., Tokyo (JP)

(72) Inventors: Nobuya Akagi, Hiroshima (JP); Yuki Higashibata, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 816 days.

(21) Appl. No.: 15/623,939

(22) Filed: Jun. 15, 2017

(65) Prior Publication Data

US 2017/0370128 A1 Dec. 28, 2017

(30) Foreign Application Priority Data

Jun. 28, 2016 (JP) ..... JP2016-127460

(51) Int. Cl.
*E05B 77/06* (2014.01)

(52) U.S. Cl.
CPC ..... *E05B 77/06* (2013.01)

(58) Field of Classification Search
CPC ..... Y10T 292/1047; Y10T 292/1078; Y10T 292/1082; E05B 77/02; E05B 77/04; E05B 77/06; Y10S 292/22; Y10S 292/23; Y10S 292/61; Y10S 292/65
See application file for complete search history.

(56) References Cited

U.S. PATENT DOCUMENTS

2010/0077806 A1* 4/2010 Yamagata ..... E05B 83/36 70/91
2011/0181052 A1* 7/2011 Brose ..... E05B 77/06 292/92
2011/0259061 A1* 10/2011 Brose ..... E05B 77/28 70/237
2012/0110920 A1 5/2012 Takagi et al.
2014/0346785 A1* 11/2014 Akagi ..... E05B 83/36 292/196
2015/0240536 A1* 8/2015 Cumbo ..... E05B 77/06 292/200
2015/0315824 A1* 11/2015 Gotzen ..... E05B 77/06 292/200

FOREIGN PATENT DOCUMENTS

JP 2011-26780 2/2011

* cited by examiner

*Primary Examiner* — Alyson M Merlino
(74) *Attorney, Agent, or Firm* — Wenderoth, Lind & Ponack, L.L.P.

(57) ABSTRACT

A door locking device includes: a latch mechanism detachably engageable with a striker; an opening lever rotatable interlockingly with a manipulation of a door handle; a transmission member swingable between an unlocking position and a locking position; and a spring member biasing the transmission member from the locking position toward the unlocking position. The spring member allows the movement of the transmission member from the unlocking position toward the locking position in a state where a force of inertia equal to or more than a set value acts on the transmission member. The door locking device also includes a restricting portion restricting biasing of the transmission member toward the unlocking position by the spring member when the transmission member is moved to the locking position against a biasing force of the spring member.

14 Claims, 12 Drawing Sheets

DOOR LOCKING DEVICE

CROSS-REFERENCE TO RELATED APPLICATIONS

This application claims priority of Japanese Patent Application No.: 2016-127460 filed on Jun. 28, 2016, the content of which is incorporated herein by reference.

BACKGROUND OF THE INVENTION

Technical Field

The present invention relates to a door locking device.

Related Art

There has been known a door locking device where a transmission member is connected to a door handle of a vehicle by way of a rod and an opening lever, and engagement of a latch mechanism with a striker is released by a manipulation of a door handle by way of the transmission member. In such a door locking device, when a large impact is applied to a door so that a door panel is deformed and the rod is lowered, the transmission member performs an opening operation. In this case, when the door locking device is in an unlocking state, there is a possibility that the door is opened.

JP 2011-026780 A discloses a door locking device includes a switch lever provided with a resin-made lever body, a metal-made inertia lever, and a coil spring as a transmission member. In such a door locking device, when a large impact is applied to a door, the inertia lever is inclined to an angle at which the inertia lever is not engageable with a latch mechanism against a biasing force of the coil spring. Accordingly, opening of the door due to an impact is prevented.

SUMMARY

However, in the door locking device disclosed in JP 2011-026780 A, when timing at which the inertia lever is inclined and timing at which a rod is moved in an opening manipulation direction are not coincident with each other, unintentional opening of the door by the switch lever cannot be prevented with certainty. That is, when the inertia lever is returned to an initial position by a biasing force of the coil spring and, thereafter, the rod is moved in an opening manipulation direction, there is a possibility that the door is opened.

It is an object of the present invention to provide a door locking device which can prevent with certainty opening of a door when an impact is applied to the door.

According to one aspect of the present invention, there is provided a door locking device which includes: a latch mechanism detachably engageable with a striker and having a manipulation receiving portion for releasing engagement of the latch mechanism with the striker; an opening lever rotatable interlockingly with a manipulation of a door handle; a transmission member swingable between an unlocking position where a rotational force of the opening lever is transmittable to the manipulation receiving portion and a locking position where the rotational force of the opening lever is not transmittable to the manipulation receiving portion; a spring member biasing the transmission member from the locking position toward the unlocking position, and allowing the movement of the transmission member from the unlocking position toward the locking position when a force of inertia equal to or more than a set value acts on the transmission member; and a restricting portion configured such that the spring member is engaged to the restricting portion in a state where the transmission member is moved to the locking position against a biasing force of the spring member due to an action of the force of inertia equal to or more than the set value thus restricting biasing of the transmission member toward the unlocking position by the spring member.

According to this door locking device, when a strong impact is applied to a door, the whole door locking device is moved due to the impact. When a force of inertia equal to or more than a set value acts on the transmission member due to such movement of the door locking device, the transmission member per se intends to keep staying at a current position. At this stage of operation, when the door locking device is in an unlocking state, a state is brought about where the transmission member is moved to a locking position against a biasing force of a spring member. As a result, the spring member is engaged to the restricting portion and hence, biasing of the transmission member toward an unlocking position is restricted. Accordingly, the transmission member is held in a state where the transmission member is moved to a locking position side.

According to the door locking device of the present invention, when the transmission member is moved to a locking position due to an action of a force of inertia, biasing of the transmission member toward an unlocking position by the spring member is restricted by the restricting portion and hence, the transmission member is held in a state where the transmission member is moved to the locking position. Accordingly, even when the connecting member connected to the opening lever is moved in a door opening manipulation direction later than the transmission member, there is no possibility that a rotational force of the opening lever is transmitted to the latch mechanism through the transmission member. Accordingly, unintentional opening of the door can be prevented with certainty.

BRIEF DESCRIPTION OF THE DRAWINGS

The foregoing and the other features of the present invention will become apparent from the following description and drawings of an illustrative embodiment of the invention in which.

DETAILED DESCRIPTION OF EMBODIMENTS

Hereinafter, embodiments of the present invention are described with reference to drawings.

First Embodiment

Figure 1:
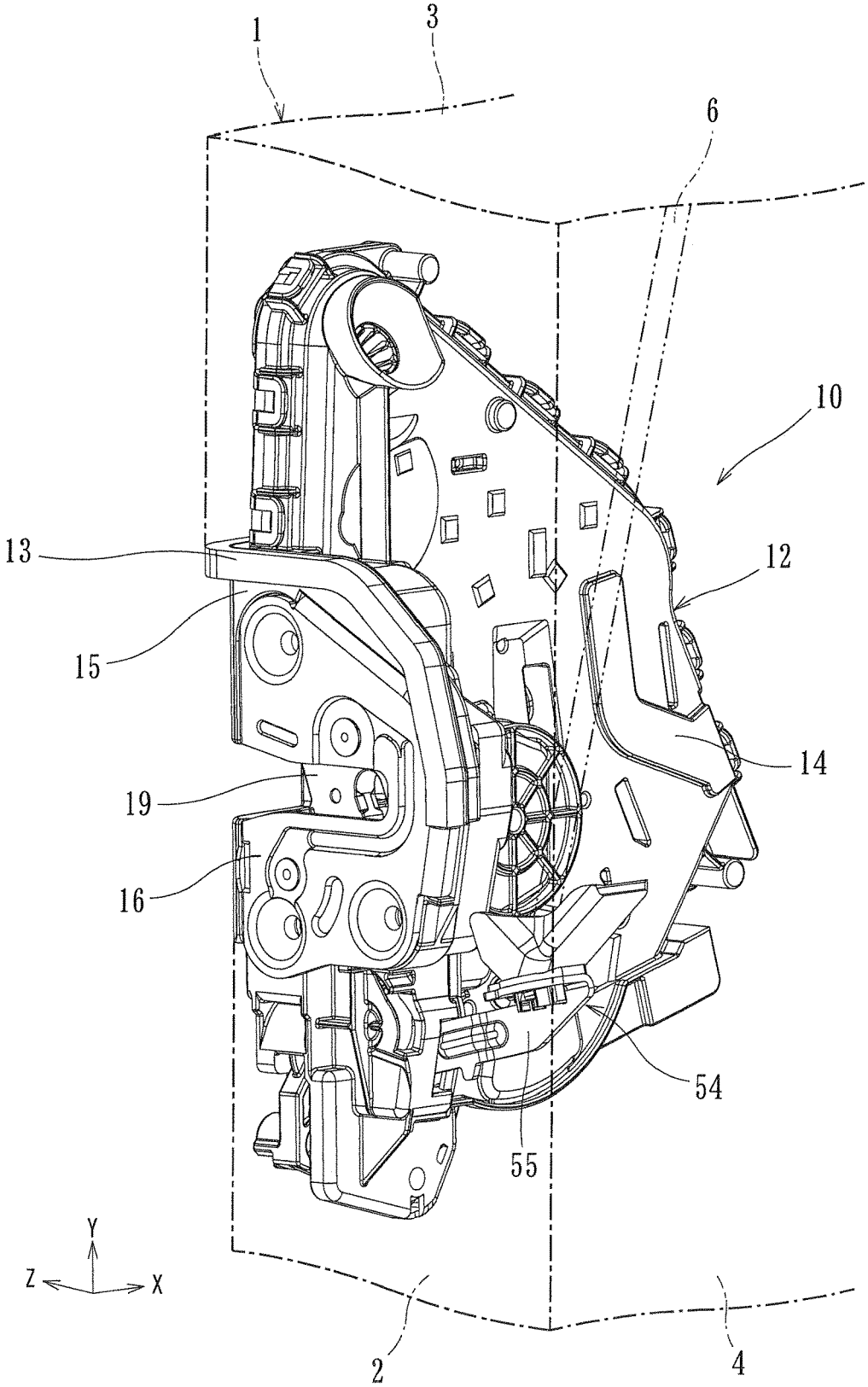
FIG. 1 is a perspective view of a door locking device assembled to a door.

FIG. 1 shows a door locking device 10 according to a first embodiment. The door locking device 10 is arranged in the inside of a door 1 of a vehicle. When a person manipulates a door handle not shown in the drawing, the door locking device 10 switches a state of the door 1 between an unlocking state where the door 1 is openable and a locking state where the door 1 is not openable. The door locking device 10 of this embodiment prevents with certainty unintentional opening of the door 1 when a large impact is applied to the door 1.

In the description made hereinafter, a vehicle longitudinal direction of the door 1 is referred to as an X direction, a vehicle height direction of the door 1 is referred to as a Y direction, and a vehicle width direction of the door 1 is referred to as a Z direction. A direction of an arrow of an X axis may be referred to as a +X direction, and a direction opposite to the +X direction may be referred to as a −X direction. The +X direction is a direction toward an end portion of the door 1 on a hinge side (a direction opposite to a direction toward an end surface 2). A direction of a Y axis indicated by an arrow may be referred to as a +Y direction, and a direction opposite to the +Y direction may be referred to as a −Y direction. The +Y direction is a direction toward an upper side in a height direction of the door 1. A direction of a Z axis indicated by an arrow may be referred to as a +Z direction, and a direction opposite to the +Z direction may be referred to as a −Z direction. The +Z direction is a direction toward a vehicle inner side (inner panel 3 side) of the door 1.

Overall Configuration

The door locking device 10 includes a housing 12 having an L shape as viewed in a plan view. A first mounting portion 13 of the housing 12 is arranged along the end surface 2 of the door 1 disposed parallel to a YZ plane, and a second mounting portion 14 of the housing 12 is arranged along an inner panel 3 of the door 1 disposed parallel to an XY plane. A fence block 15 is arranged on the first mounting portion 13 as a base member, and the −X side of the fence block 15 is covered by a metal-made cover 16.

Figure 3A:
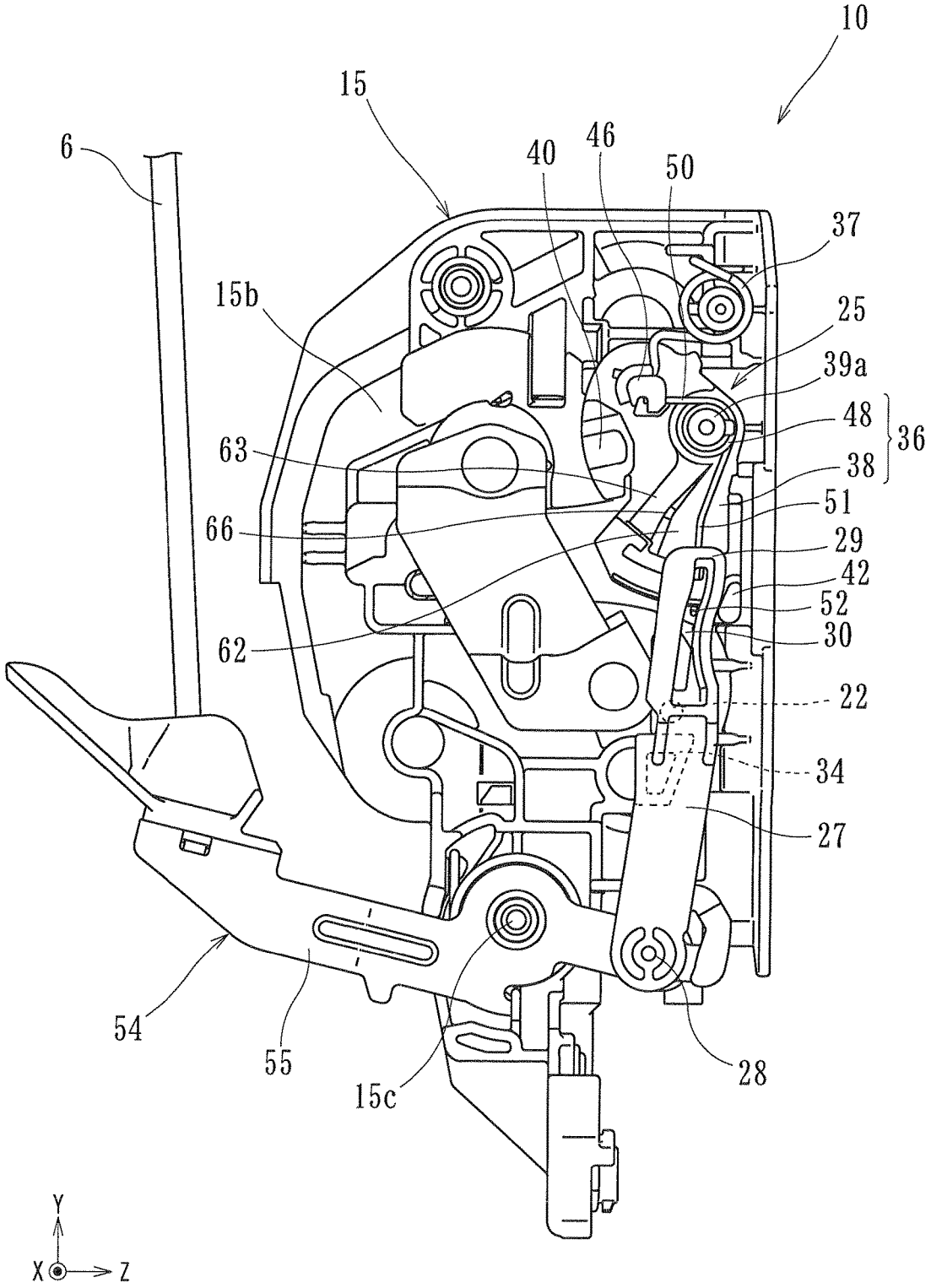
FIG. 3A is a front view showing a locking mechanism in a first embodiment in an unlocking state.
Figure 4A:
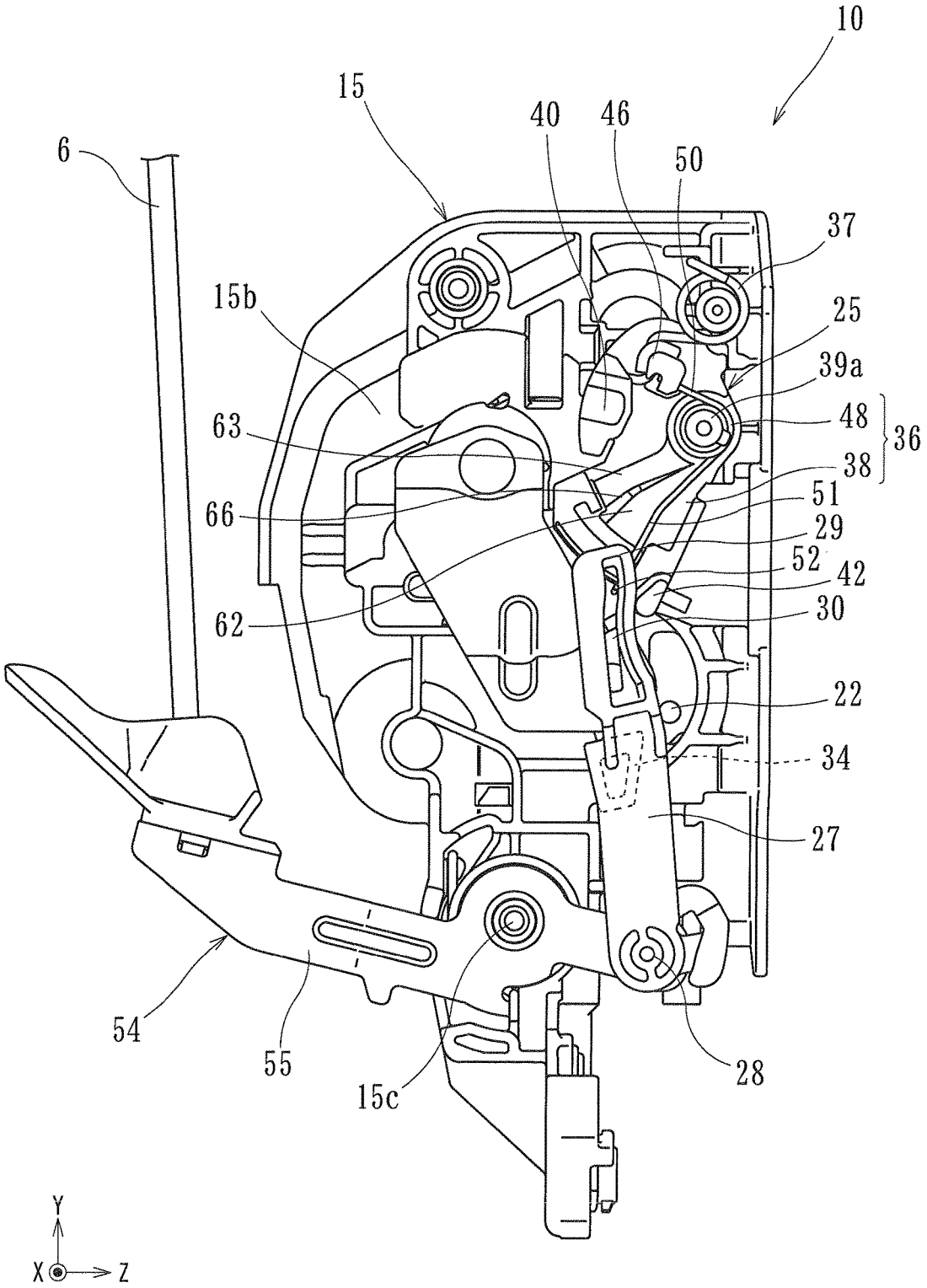
FIG. 4A is a front view of the locking mechanism in the first embodiment in a locking state.
Figure 4B:
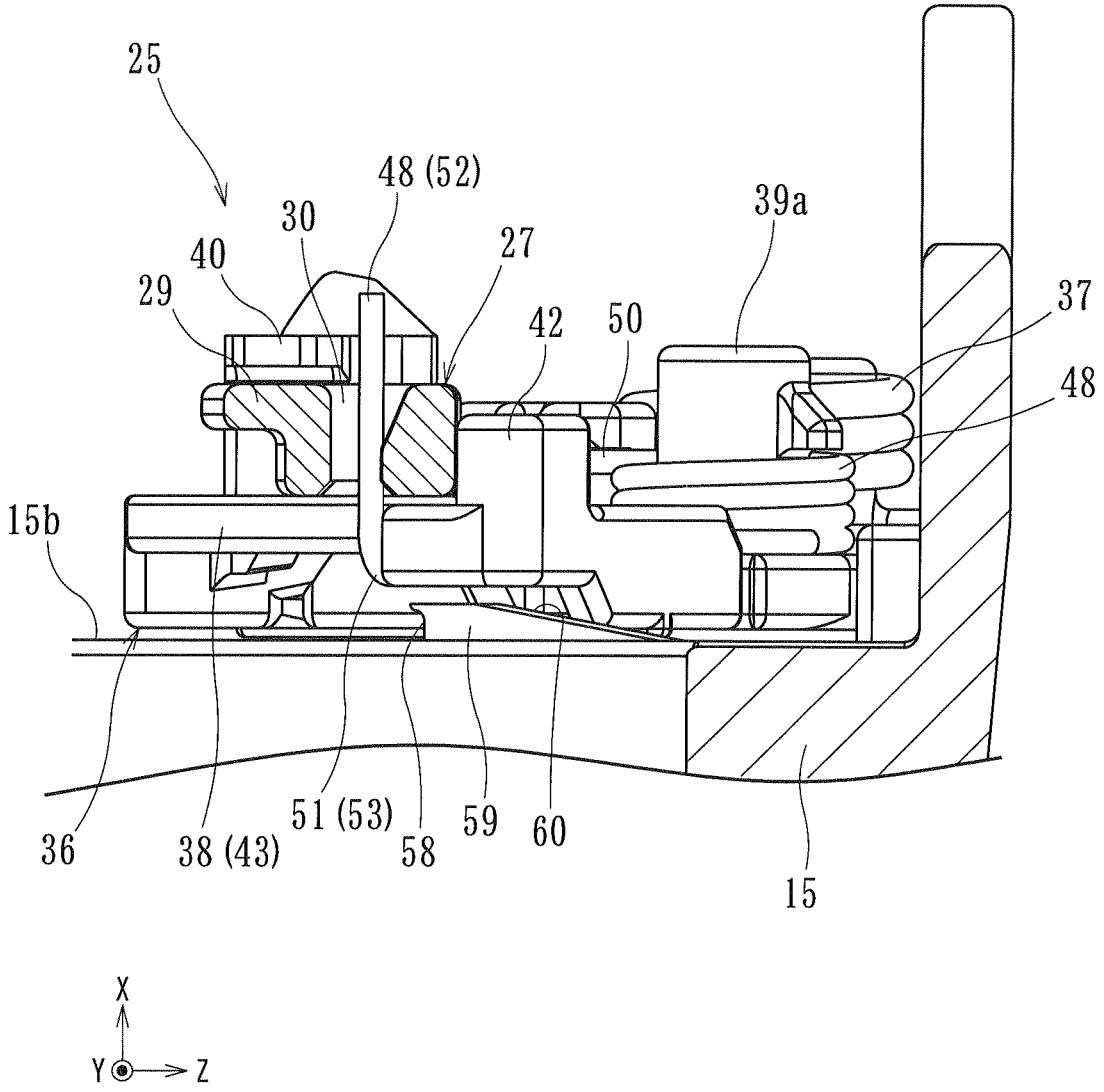
FIG. 4B is a cross-sectional view showing a portion of the locking mechanism shown in FIG. 4A.

A latch mechanism 18 is mounted on a first arrangement surface 15*a* of the fence block 15 positioned on the −X side, and a locking mechanism 25 and an opening mechanism 54 are mounted on a second arrangement surface 15*b* of the fence block 15 positioned on the +X side. Referencing FIG. 2, the latch mechanism 18 includes a fork 19 and a claw lever 21. The latch mechanism 18 is detachably engaged with a U-shaped striker 8 mounted on a vehicle body. With reference to FIGS. 3A and 4A, the locking mechanism 25 includes a link 27 and a locking lever 36. The locking mechanism 25 is displaced between an unlocking state where the engagement between the latch mechanism 18 and the striker 8 can be released and a locking state where the engagement between the latch mechanism 18 and the striker 8 cannot be released. The opening mechanism 54 includes an opening lever 55 which transmits a manipulation force of a door handle to the link 27. One end side of the opening lever 55 is connected to a rod (connecting member) 6, the other end side of the opening lever 55 is connected to the link 27, and an intermediate portion of the opening lever 55 is rotatably and pivotally supported on a shaft portion 15*c* formed on the fence block 15. A switching mechanism not shown in the drawing which switches a state of the locking mechanism 25 is mounted on the second mounting portion 14.

Figure 2:
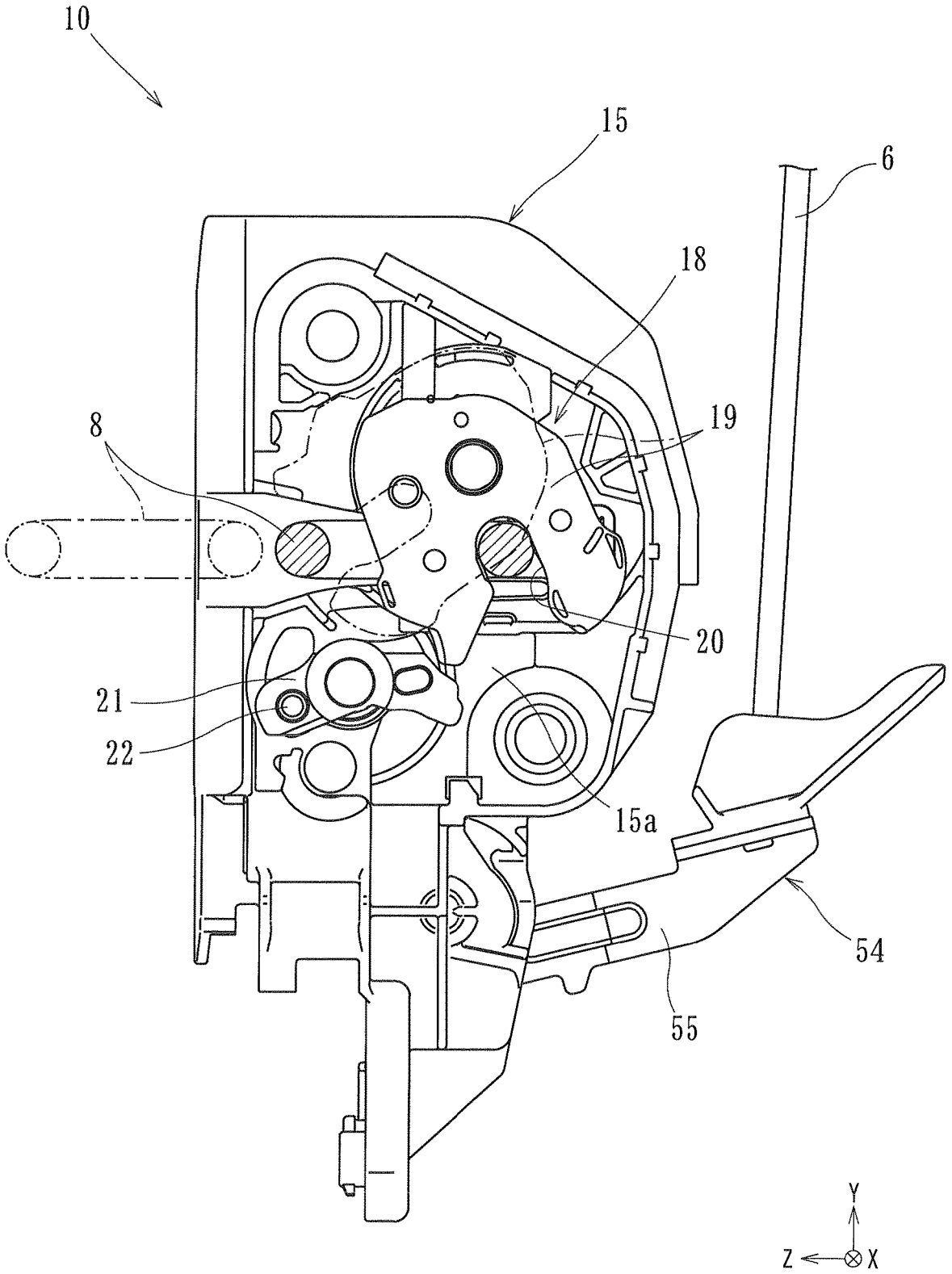
FIG. 2 is a front view of a latch mechanism of the door locking device.

When the door 1 in an open state is closed, the striker 8 enters an engaging groove 20 of the fork 19 so that the fork 19 is rotated in a counterclockwise direction from a release position indicated by a chain line in FIG. 2 toward an engaging position indicated by a solid line in FIG. 2. With such a rotation, the claw lever 21 locks the fork 19 so that an engaging state between the fork 19 and the striker 8 is maintained. As a result, the door 1 is held in a closed state with respect to the vehicle body.

When an opening manipulation of the door handle is performed, the rod 6 is moved linearly in the downward direction in FIG. 1 so that the opening lever 55 is rotated in the clockwise direction in FIG. 2. With such rotation of the opening lever 55, the link 27 forming the transmission member is moved linearly in an interlocking manner from a retracted position shown in FIGS. 3A and 4A to an advanced position disposed above the retracted position. When the opening manipulation of the door handle is stopped, the link 27 is returned to the retracted position from the advanced position by a spring (not shown in the drawing) which biases the opening lever 55.

In performing such an opening manipulation, when the locking mechanism 25 is in an unlocking state shown in FIG. 3A, the link 27 transmits a rotational force of the opening lever 55 to the claw lever 21. A manipulation receiving portion 22 of the claw lever 21 penetrates the fence block 15, and projects toward the link 27. When an operating portion 34 of the link 27 pushes the manipulation receiving portion 22 upward so that the claw lever 21 is rotated in the clockwise direction in FIG. 2, locking engagement between the claw lever 21 and the fork 19 is released. With such releasing of locking engagement, the fork 19 is rotated in the clockwise direction toward the release position so that the striker 8 can be removed from the fork 19. Accordingly, the door 1 is brought into an openable state with respect to the vehicle body.

In performing an opening manipulation, when the locking mechanism 25 is in a locking state shown in FIG. 4A, the link 27 is moved linearly in the oblique upper left direction in FIG. 4A. Accordingly, the operating portion 34 idles without being brought into contact with the manipulation receiving portion 22 of the claw lever 21. As a result, locking between the claw lever 21 and the fork 19 cannot be released so that engagement between the fork 19 and the striker 8 also cannot be released and hence, the door 1 is held in a non-openable state with respect to the vehicle body.

Switching of the locking mechanism 25 between the unlocking state and the locking state is performed by a switching mechanism disposed in the inside of the second mounting portion 14. For example, the switching mechanism includes an actuator formed of an electric motor and a connecting lever. The locking lever 36 has a connecting portion 40 which is connected to the locking lever 36 at a position which communicates with the inside of the second mounting portion 14.

When a person manipulates a remote controller or a switch for performing a door locking operation, the locking lever 36 is rotated through the actuator in the clockwise direction from an unlocking position shown in FIG. 3A to a locking position shown in FIG. 4A. With such rotation of the locking lever 36, an upper end of the link 27 swings in the counterclockwise direction so that a locking state is obtained. On the other hand, when the person manipulates the remote controller or the switch for performing a door unlocking operation, the locking lever 36 is rotated by means of the actuator in the counterclockwise direction from a locking position shown in FIG. 4A to an unlocking position shown in FIG. 3A, With such rotation of the locking lever 36, the upper end of the link 27 swings in the clockwise direction so that an unlocking state is obtained.

Figure 5A:
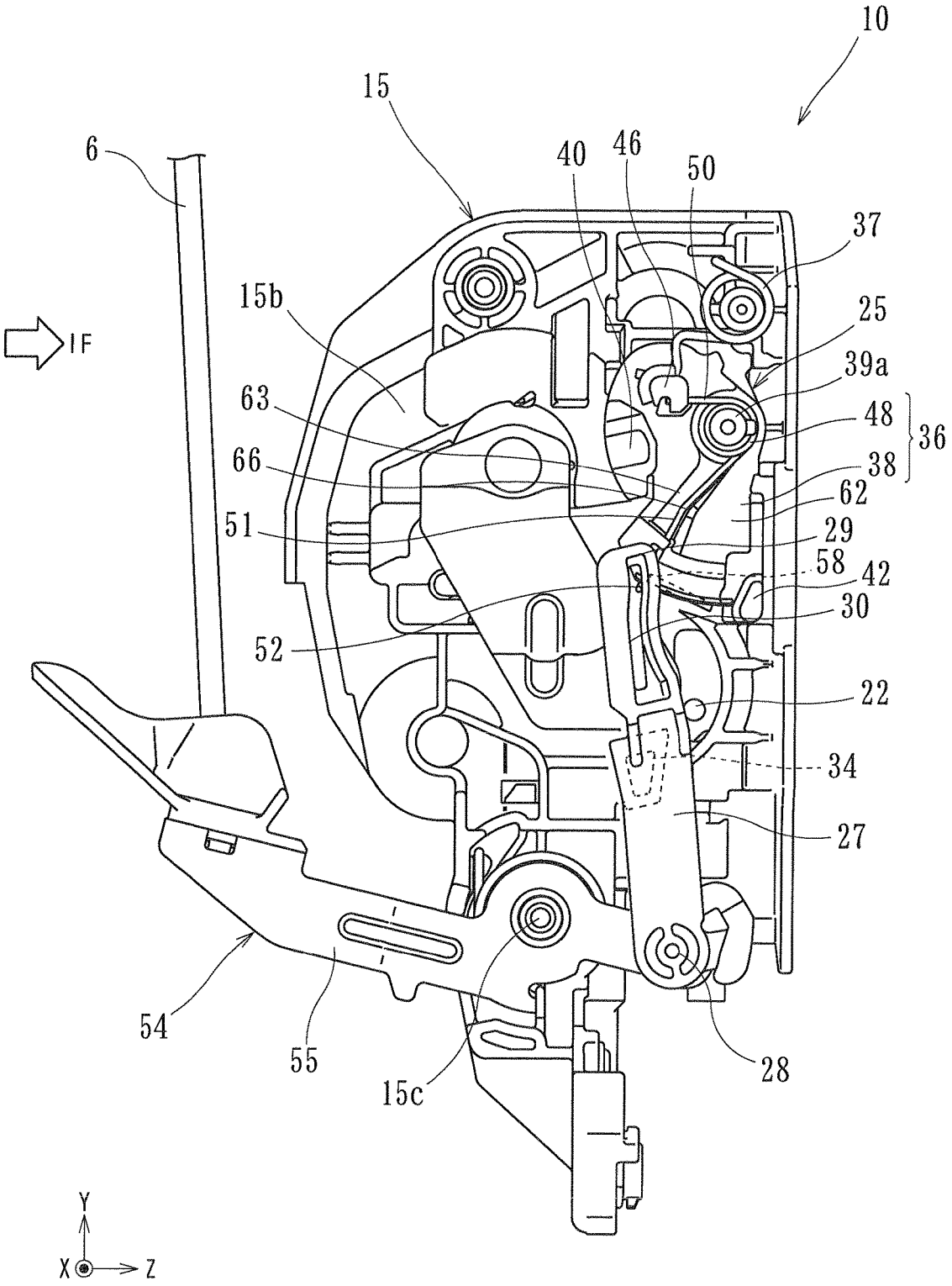
FIG. 5A is a front view showing the locking mechanism when an impact is applied to the locking mechanism in an unlocking state.

In general, when a large impact is applied to the door 1 in a state where the door locking device is in an unlocking state so that the outer panel 4 is deformed and the rod 6 is moved in the opening manipulation direction, the door 1 is brought into an openable state. To prevent such a drawback, according to this embodiment, as shown in FIG. 5A, when a large impact IF is applied to the door 1, the link 27 at an unlocking position is moved to a locking position. With such a configuration, opening of the door 1 when an impact is applied to the door 1 can be prevented.

Detail of Locking Operation When Impact is Applied to Door

As shown in FIGS. 3A and 4A, the link 27 is arranged swingably with respect to the locking lever 36, and is biased by a spring member 48 in a direction toward an initial position with respect to the locking lever 36. As shown in FIG. 5A, the door locking device 10 is configured such that when a force of inertia equal to or more than a set value which is set in advance acts on the link 27 due to an impact IF, the link 27 is moved from the initial position toward the operating position against a biasing force of the spring member 48. The door locking device 10 is also configured such that when a force of inertia which acts on the link 27 is less than the set value, the link 27 is not moved to the operating position or a state where the link 27 is biased toward the initial position is maintained. The initial position of the link 27 is set on a side where the locking lever 36 is at an unlocking position, and the operating position of the link 27 is set on a side where the locking lever 36 is at a locking position.

To be more specific, the link 27 is a mass body made of a metal material. In this embodiment, the mass body means a member which is made of a material having a larger specific gravity than a resin which is a molding material for forming other members, and can continuously stay at a current position when an impact IF is applied to the door locking device 10 so that a force of inertia acts on the link 27. The link 27 is swingably connected to the locking lever 36 in an advancing and retracting manner.

The link 27 includes an input portion 28 formed on a lower end (one end in the Y direction) thereof, a connecting portion 29 formed on an upper end (the other end in the Y direction) thereof, and an operating portion 34 formed on an intermediate portion thereof. The opening lever 55 is rotatably connected to the input portion 28. The connecting portion 29 is arranged on the +X side of the locking lever 36 in an overlapping manner. The connecting portion 29 has a guide hole 30 extending along the advancing and retracting direction (approximately Y direction) of the link 27. The operating portion 34 projects in the −X direction toward the claw lever 21 between the input portion 28 and the connecting portion 29.

Figure 6A:
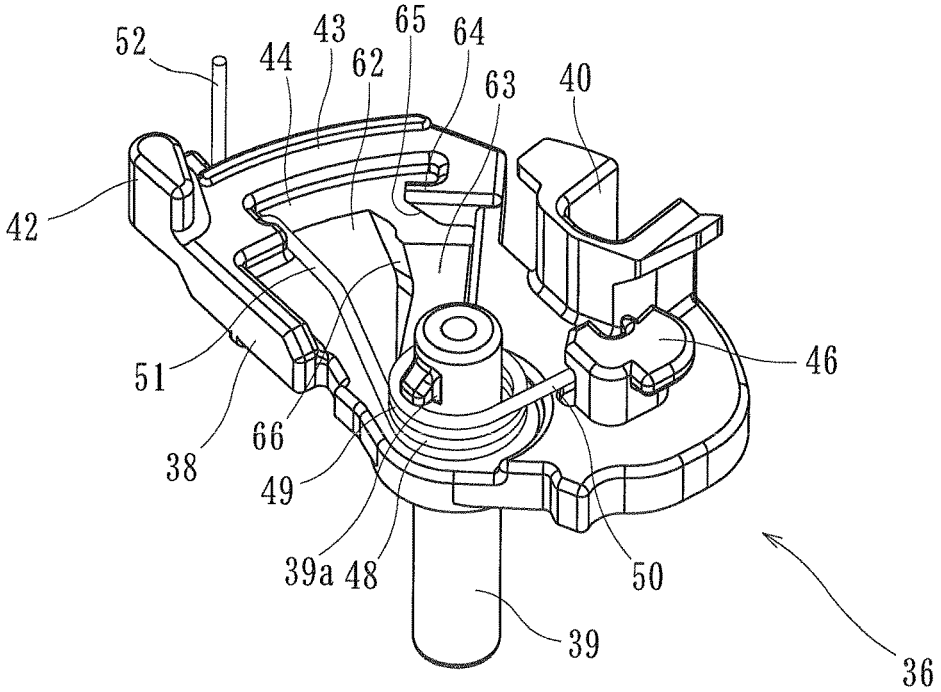
FIG. 6A is a perspective view showing a locking lever.
Figure 6B:
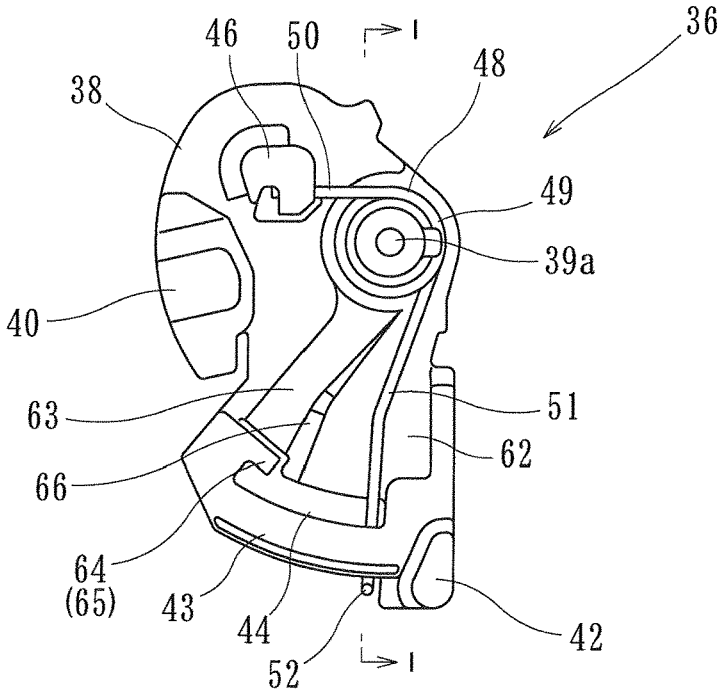
FIG. 6B is a front view of the locking lever shown in FIG. 6A.
Figure 6C:
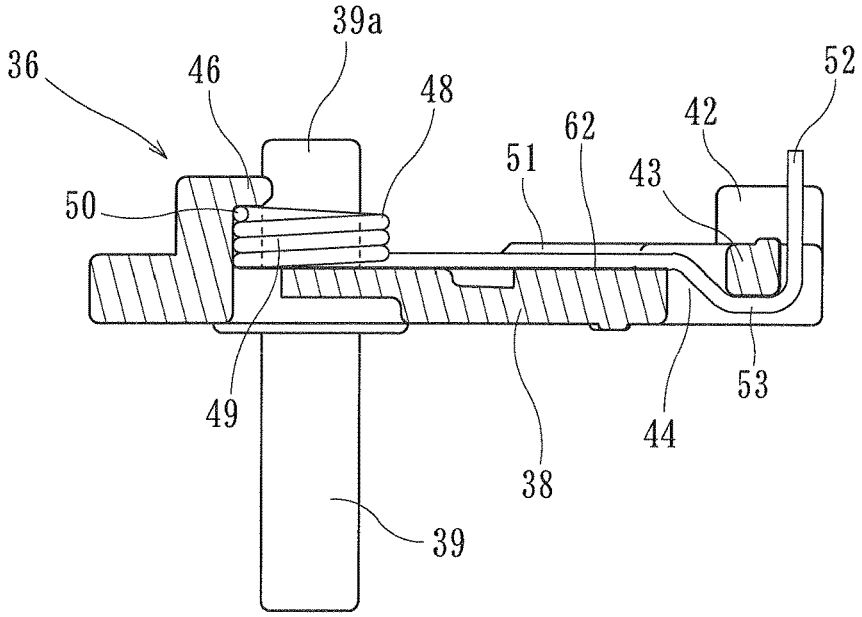
FIG. 6C is a cross-sectional view taken along a line I-I in FIG. 6B.
Figure 7A:
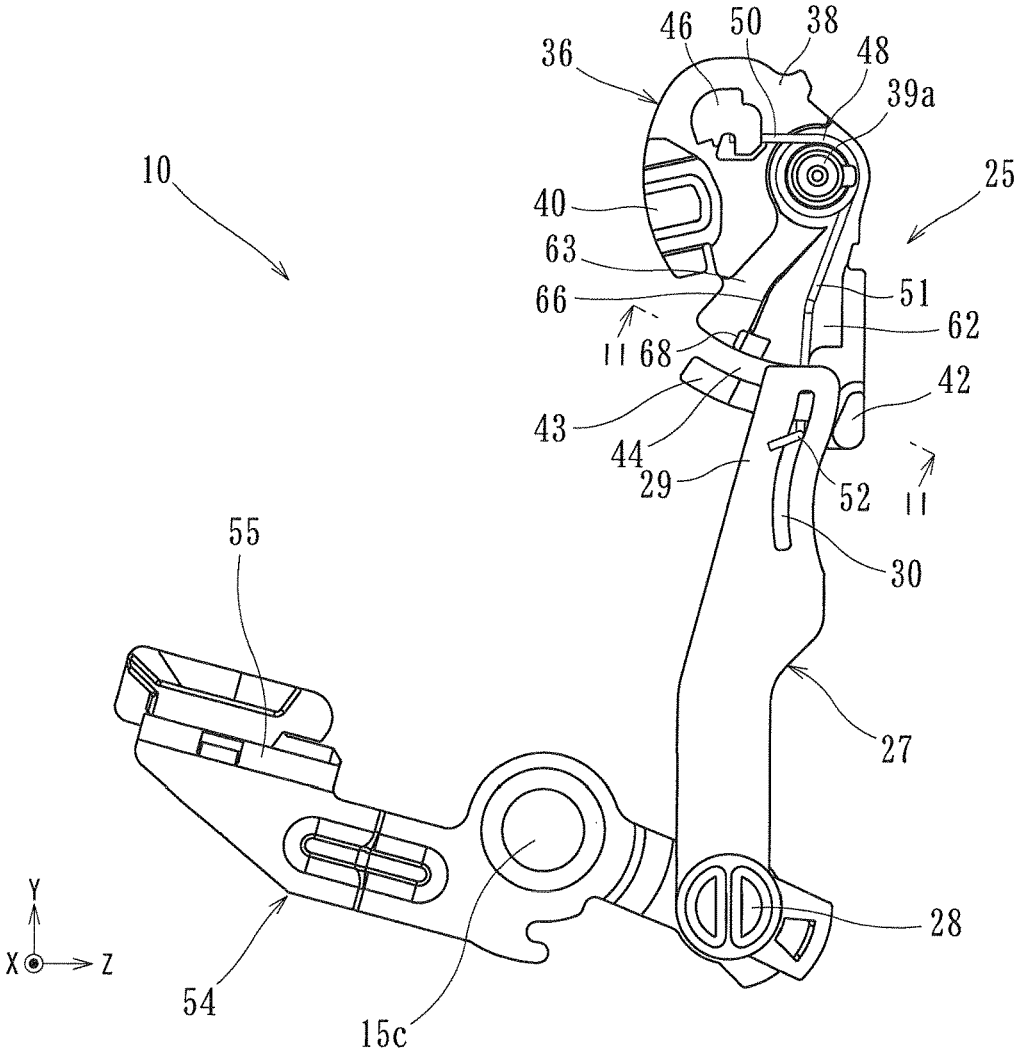
FIG. 7A is a front view of a locking mechanism in a second embodiment in an unlocking state.
Figure 7B:
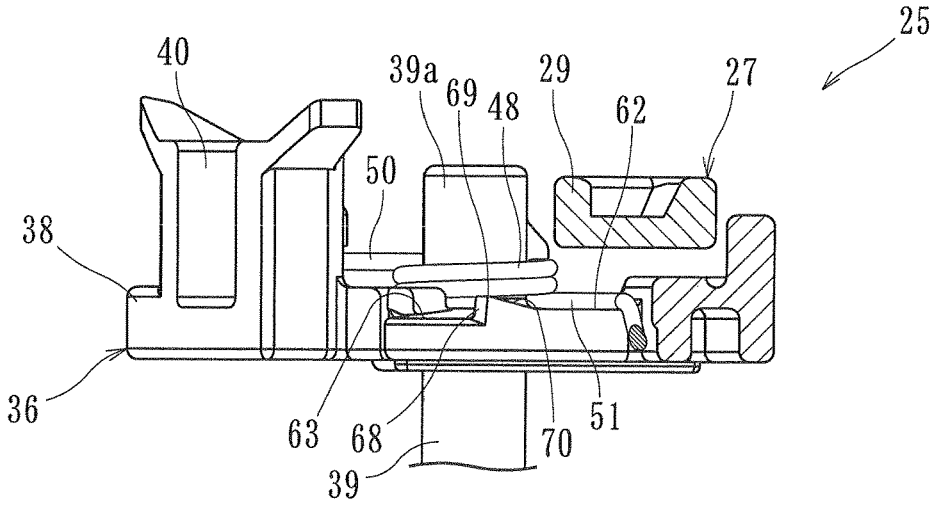
FIG. 7B is a cross-sectional view taken along a line II-II in FIG. 7A.
Figure 8A:
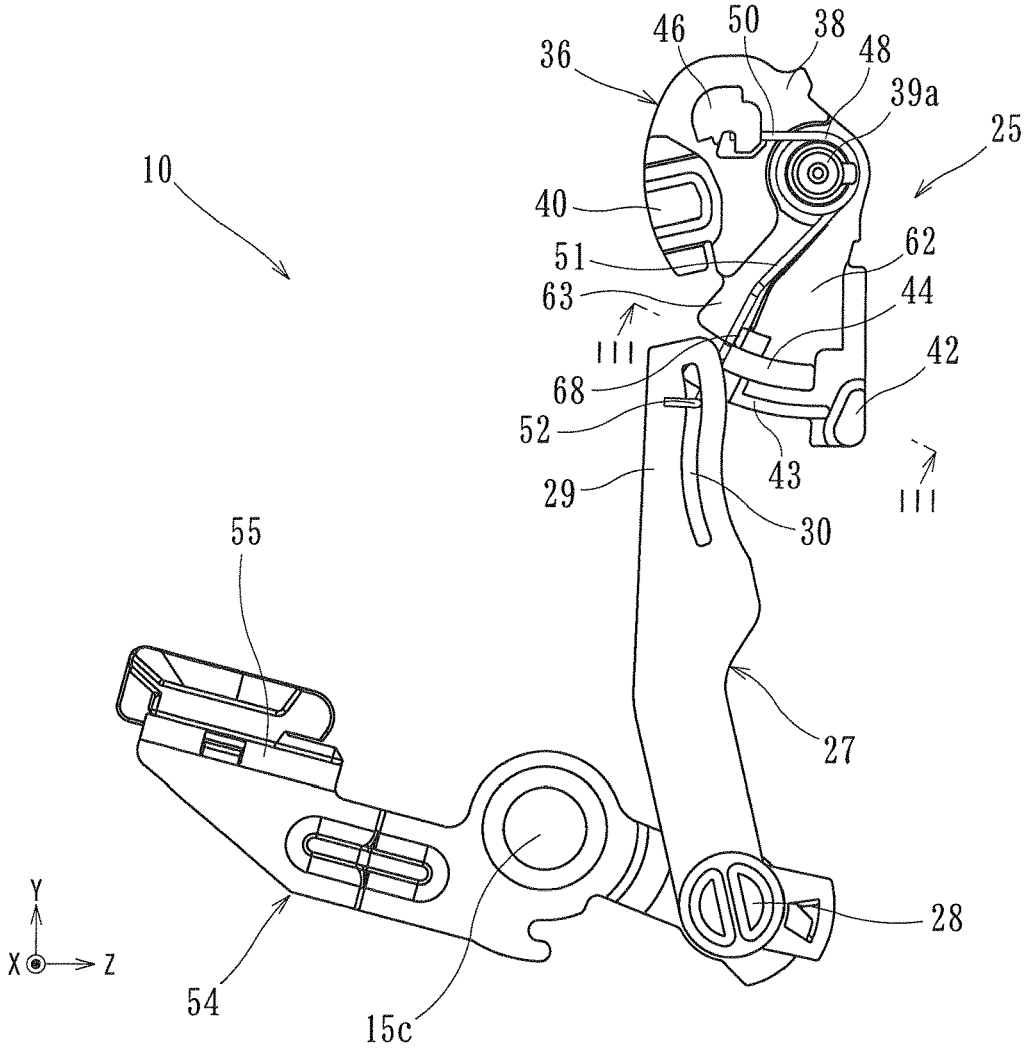
FIG. 8A is a front view showing a locking mechanism when an impact is applied to the locking mechanism in an unlocking state.
Figure 8B:
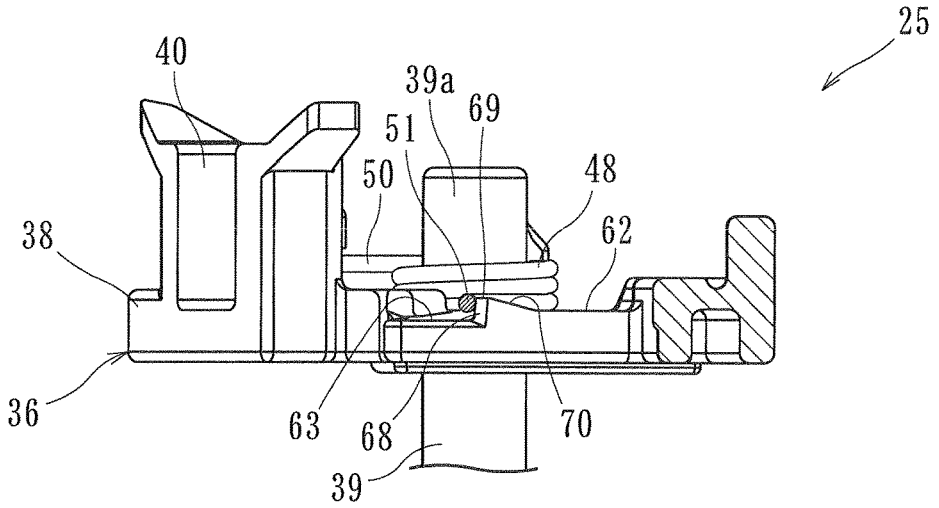
FIG. 8B is a cross-sectional view taken along a line in FIG. 8A.

Also with reference to FIGS. 6A to 6C, the locking lever 36 includes a lever body 38, and a spring member 48 arranged on the lever body 38. The locking lever 36 is switched between an unlocking position and a locking position, and is held at the unlocking position or the locking position by a spring 37 arranged on the fence block 15.

The lever body 38 includes a shaft portion 39 for rotatably mounting the lever body 38 on the fence block 15. The previously-mentioned connecting portion 40 is formed on the lever body 38 in a spaced-apart manner from the shaft portion 39. On a lower side of the lever body 38 where the link 27 is arranged, a stopper portion 42 and a guide piece 43 are formed.

The stopper portion 42 projects on a side where the connecting portion 29 of the link 27 is arranged, that is, projects in the +X direction, and is formed on an end portion on the unlocking position side. The guide piece 43 has an arcuate shape about the shaft portion 39, and extends in a direction directed to the locking position toward the −Z side from the stopper portion 42. The connecting portion 29 is arranged on a surface of the guide piece 43 on the +X side, and the stopper portion 42 is positioned on an edge of the connecting portion 29 on the unlocking position side. An insertion groove 44 having a predetermined size is formed between the guide piece 43 and the shaft portion 39. A locking portion 46 which locks an end portion of the spring member 48 is also formed on the lever body 38.

The spring member 48 is a kick spring which biases the link 27 in the +Z direction from the operating position to the initial position. A winding portion 49 is arranged at an extending portion 39*a* of the shaft portion 39 which projects toward the +X side from the lever body 38. A first arm portion 50 is engaged to the locking portion 46 of the lever body 38. A second arm portion 51 projects toward the link 27 through the insertion groove 44 and the guide piece 43. A distal end of the second arm portion 51 forms a guide projecting portion 52 which is inserted into the guide hole 30 of the link 27. The guide projecting portion 52 can be moved in the Z direction along the guide piece 43, and biases the connecting portion 29 by a biasing force of the spring member 48 to the initial position where the connecting portion 29 is brought into contact with the stopper portion 42.

Next, an operation principle of the door locking device when a force of inertia equal to or more than a set value acts on the link 27 is described.

In an unlocking state shown in FIG. 3A, when an impact IF is applied to the door 1 from the vehicle outer side to the vehicle inner side (see FIG. 5A), the whole door locking device 10 is rapidly moved in the +Z direction due to such an impact IF. At this point of time, the locking lever 36 is maintained in a state where the locking lever 36 is rotated to the unlocking position by a biasing force of the spring 37. On the other hand, the link 27 keeps staying at a current position because of mass of the link 27 per se. Accordingly, as shown in FIG. 5A, a state is brought about where the link 27 is moved to the operating position (locking position) against a biasing force of the spring member 48.

A set value which allows the movement of the link 27 toward the operating position is determined based on an impact force applied to the door 1, the mass of the link 27, and a biasing force of the spring member 48. In the case where the set value is set to an excessively large value, when an impact is applied to the door 1, the movement of the link 27 to the operating position becomes difficult. On the other hand, in the case where the set value is set to an excessively small value, even when an impact generated at the time of opening and closing the door 1 is applied to the door 1, the link 27 is moved to the operating position. That is, neither an excessively large value nor an excessively small value is preferable as the set value. In view of the above, in this embodiment, the mass of the link 27 and a biasing force of the spring member 48 are set such that when an impact force which may generate the deformation of the outer panel 4 is applied to the door 1, the link 27 is moved to the operating position.

In the door locking device 10 having such a configuration, in the case where the locking lever 36 is at the unlocking position, when a force of inertia equal to or more than a predetermined value acts on the link 27, the link 27 is moved to the operating position (locking position). Accordingly, when a large impact is applied to the door 1, opening of the door 1 caused due to the movement of the rod 6 in the opening manipulation direction can be prevented. Further, the link 27 is formed as a mass body and hence, the link 27 per se and the whole door locking device 10 can be downsized.

Maintaining of Operating State of Link

In the door locking device having the above-mentioned configuration, when the link moved to the operating position is returned to the initial position by a biasing force of the spring member and, thereafter, the rod is moved in the opening manipulation direction, the door is brought into an openable state. In view of the above, in the door locking device 10 of this embodiment, as shown in FIG. 5A, when the link 27 is moved to the operating position in a state where the locking lever 36 is moved to the unlocking position, biasing of the link 27 to the initial position by the spring member 48 is restricted. With such restriction, returning of the link 27 to the initial position is prevented and hence, the door 1 is maintained in a non-operable state.

Figure 5B:
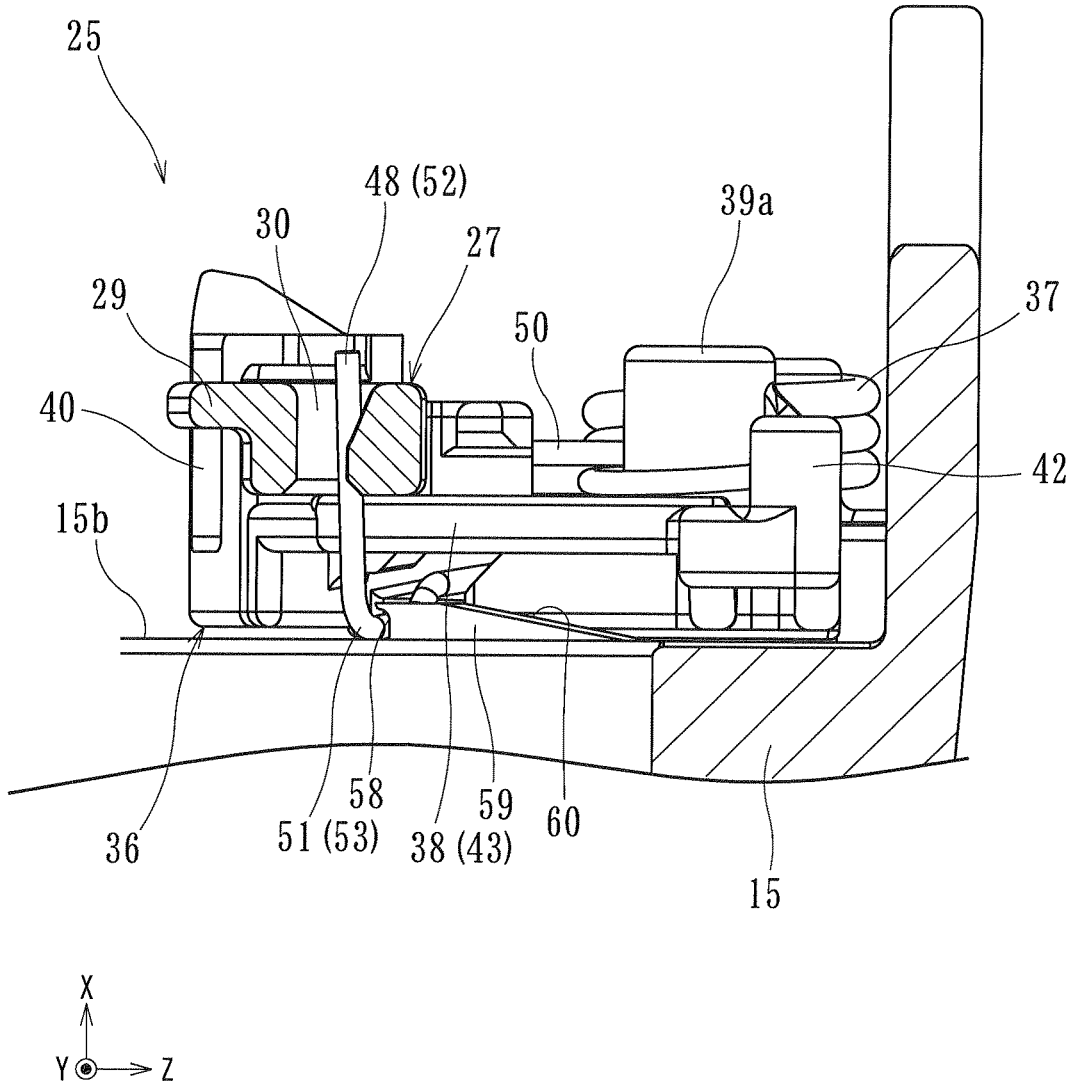
FIG. 5B is a cross-sectional view showing a portion of the locking mechanism shown in FIG. 5A.
Figure 5C:
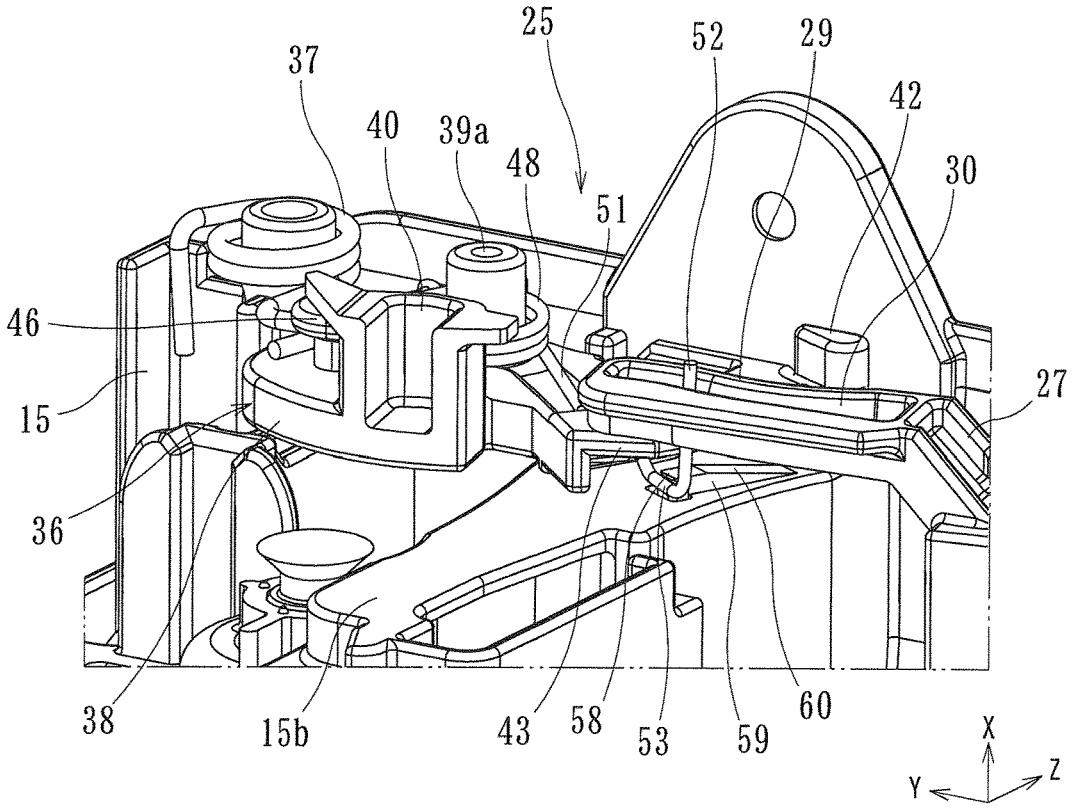
FIG. 5C is a perspective view showing a portion of the locking mechanism shown in FIG. 5A.

As shown in FIGS. 5A to 5C, in the fence block 15, a restricting portion 58 which locks the second arm portion 51 of the spring member 48 is formed on the second arrangement surface 15*b* where the locking lever 36 and the link 27 are arranged. The restricting portion 58 projects in the +X direction from the second arrangement surface 15*b* toward the locking lever 36, and is formed on an end portion of a projecting ridge portion 59 extending in the Z direction on the operating position side. The projecting ridge portion 59 has an inclined surface 60 which is inclined in the +X direction from the initial position to the operating position.

A biasing direction of the second arm portion 51 is set such that the second arm portion 51 is moved in the +Z direction toward the initial position as described above, and is also moved in the −X direction toward the second arrangement surface 15*b*. In the second arm portion 51, a proximal portion of the guide projecting portion 52 forms a portion to be engaged 53 which is engaged to the restricting portion 58. The portion to be engaged 53 is positioned between the guide piece 43 and the second arrangement surface 15*b*, and extends parallel to the second arrangement surface 15*b*.

Figure 3B:
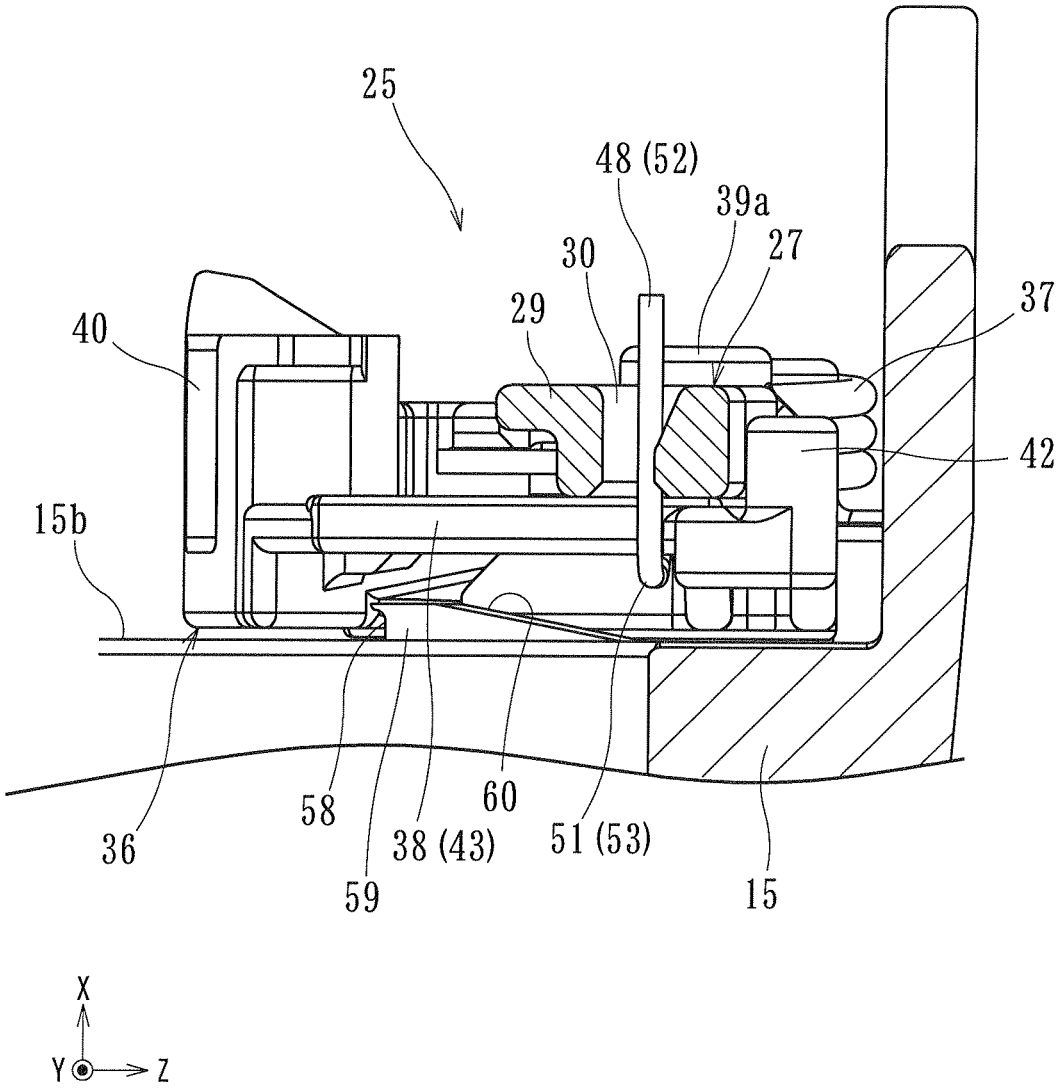
FIG. 3B is a cross-sectional view showing a portion of the locking mechanism shown in FIG. 3A.

The lever body 38 has a first holding portion 62 on the initial position side, and has a second holding portion 63 on the operating position side. With reference to FIGS. 3A and 3B together with FIG. 6A, the first holding portion 62 holds the second arm portion 51 at a position where the second arm portion 51 is not lockable to the restricting portion 58. With reference to FIGS. 5A and 5B together with FIG. 6A, the second holding portion 63 holds the second arm portion 51 at a position where the second arm portion 51 is lockable to the restricting portion 58. The first holding portion 62 is formed at a position remoter from the second arrangement surface 15*b* to the +X side than the second holding portion 63 is. The first and second holding portions 61, 63 are respectively flat surfaces parallel to the second arrangement surface 15*b*.

The lever body 38 includes a guide portion 65 which guides the second arm portion 51 from the first holding portion 62 to the second holding portion 63 when the second arm portion 51 is moved from the initial position to the operating position. As most clearly shown in FIG. 6A, the guide portion 65 is formed on a protrusion 64 which protrudes from an end portion of the guide piece 43 on the operating position side toward the initial position. The guide portion 65 is inclined from the first holding portion 62 toward the second holding portion 63.

As shown in FIGS. 3A to 4B, in a state where the second arm portion 51 is held on the first holding portion 62, the portion to be engaged 53 is positioned more on the +X side than the restricting portion 58 is. When the locking lever 36 is rotated from the unlocking position to the locking position in such a state, the link 27 is pushed by the stopper portion 42 so that the link 27 is rotated together with the locking lever 36. Accordingly, the second arm portion 51 is maintained in a state where the second arm portion 51 is held on the first holding portion 62. When the locking lever 36 is rotated from the locking position to the unlocking position, the second arm portion 51 is biased toward the initial position and the first holding portion 62 and hence, the second arm portion 51 is maintained in a state where the second arm portion 51 is held on the first holding portion 62. Accordingly, there is no possibility that the portion to be engaged 53 is engaged to the restricting portion 58. With such a configuration, there is no possibility that an operation of the locking lever 36, an operation of the spring member 48, and an operation of the link 27 are interrupted by the restricting portion 58.

On the other hand, in a state where the locking lever 36 is moved to the unlocking position, when the link 27 is moved to the operating position due to an action of a force of inertia, as shown in FIGS. 5A to 5C, the second arm portion 51 is moved from the first holding portion 62 to the second holding portion 63. At this point of time, the second arm portion 51 irregularly vibrates due to an impact applied to the door 1. However, the second arm portion 51 is guided by the guide portion 65 so that the second arm portion 51 is moved to the second holding portion 63 with certainty. The second arm portion 51 is held on the second holding portion 63 by a biasing force of the spring member 48.

In a state where the second arm portion 51 is moved to the second holding portion 63, the portion to be engaged 53 and the restricting portion 58 is coincidentally positioned at the same position in the X direction. Accordingly, a force of inertia is weakened so that the second arm portion 51 is moved to the initial position by a biasing force and hence, the portion to be engaged 53 is engaged to the restricting portion 58. With such locking of the portion to be engaged 53, the movement of the second arm portion 51, toward the initial position is restricted. As a result, the link 27 where the guide projecting portion 52 is inserted into the guide hole 30 is held at the operating position together with the second arm portion 51 so that the movement of the link 27 toward the initial position is restricted.

As described above, in the door locking device 10 of this embodiment, the link 27 is also held at the operating position only when an impact is applied to the door 1 and the link 27 is moved to the operating position. Accordingly, even when the rod 6 is moved in the opening manipulation direction of the door 1 with a delay, there is no possibility that a rotational force of the opening lever 55 is transmitted to the latch mechanism 18 by way of the link 27. Accordingly, unintentional opening of the door 1 can be prevented with certainty.

The lever body 38 has a contact portion 66 which releases locking between the second arm portion 51 and the restricting portion 58 when the locking lever 36 is rotated in the direction from the unlocking position to the locking position. As most clearly shown in FIG. 6A, the contact portion 66 is formed on a stepped portion between the first holding portion 62 and the second holding portion 63. The contact portion 66 is inclined in the +X direction from the second holding portion 63 to the first holding portion 62.

As shown in FIGS. 5A and 5C, in a state where the locking lever 36 is moved to the unlocking position and the link 27 is moved to the operating position, when the locking lever 36 is rotated toward the locking position, the contact portion 66 is brought into contact with the second arm portion 51. Such contacting of the contact portion 66 with the second arm portion 51 makes the contact portion 66 move the second arm portion 51 toward the locking position thus releasing locking between the second arm portion 51 and the restricting portion 58. Due to such movement of the locking lever 36 in the −Z direction and biasing of the second arm portion 51 in the +Z direction, a state is brought about where the second arm portion 51 is moved from the second holding portion 63 to the first holding portion 62 along an inclination of the contact portion 66 against a biasing force in the −X direction. With such movement of the second arm portion 51, the second arm portion 51 is returned to a state where the second arm portion 51 is held on the first holding portion 62, and the link 27 is moved to the initial position with respect to the locking lever 36 by a biasing force in the +Z direction applied to the second arm portion 51.

As described above, a state where the link 27 is held at the operating position is released when the switching mechanism switches a state of the locking mechanism 25 from the unlocking state to the locking state. With such a switching operation, the second arm portion 51 is returned to the initial position where the second arm portion 51 is not lockable to the restricting portion 58. Accordingly, it is unnecessary to provide a dedicated locking release member which is exclusively provided for releasing locking between the second arm portion 51 and the restricting portion 58 and hence, the door locking device 10 can be simplified.

Second Embodiment

FIGS. 7A to 8B show a locking mechanism 25 and an opening lever 55 of a door locking device 10 of a second embodiment. In the second embodiment, a restricting portion 68 which locks a second arm portion 51 at an operating position is formed on a locking lever 36. A link 27 and the opening lever 55 in the second embodiment have substantially the same configuration and function as the link 27 and the opening lever 55 used in the first embodiment.

In the same manner as the first embodiment, the locking lever 36 includes a lever body 38 and a spring member 48. The lever body 38 includes: a shaft portion 39; a connecting portion 40; a stopper portion 42; a locking portion 46; a first holding portion 62; a second holding portion 63; and a contact portion 66 in the same manner as the first embodiment. A guide piece 43 and an insertion groove 44 are respectively formed such that an end portion of each member is opened on the operating position side (−Z side). Neither a protrusion 64 nor a guide portion 65 is formed on the lever body 38.

A restricting portion 68 is formed on an end portion of the contact portion 66 on the link 27 side (−Y side). The restricting portion 68 is inclined in the biasing direction of the second arm portion 51, that is, in the direction away from the second holding portion 63. An angle made by the second holding portion 63 and the restricting portion 68 is set larger than 90 degrees. The restricting portion 68 is formed with an inclination angle which allows locking of the second arm portion 51 against a biasing force applied to the second arm portion 51. An end portion 69 of the restricting portion 68 on a side (+X direction) opposite to the biasing direction of the second arm portion 51 (−X direction) projects more in the +X direction than the first holding portion 62 does. The end portion 69 and the first holding portion 62 are continuously formed with an inclined surface 70 formed therebetween.

In the door locking device 10 of the second embodiment, in a state where the second arm portion 51 is held on the first holding portion 62, when the locking lever 36 is rotated from an unlocking position to a locking position, the second arm portion 51 is rotated together with the locking lever 36. Also when the locking lever 36 is rotated from the locking position to the unlocking position, the second arm portion 51 is rotated together with the locking lever 36. Accordingly, there is no possibility that the second arm portion 51 is engaged to the restricting portion 68.

On the other hand, in a state where the locking lever 36 is moved to the unlocking position, when the link 27 is moved to an operating position (locking position) due to an action of a force of inertia, the second arm portion 51 is moved to the second holding portion 63. Then, the second arm portion 51 is moved in the +X direction along the inclined surface 70 while being moved in the −Z direction, and gets over the end portion 69 so that the second arm portion 51 is held on the second holding portion 63. Then, a force of inertia is weakened so that the second arm portion 51 is moved to the initial position by a biasing force whereby the second arm portion 51 is engaged to the restricting portion 68. Accordingly, in the same manner as the first embodiment, the movement of the second arm portion 51 toward the initial position is restricted, and the link 27 is held at the operating position together with the second arm portion 51. As a result, even when the rod 6 is moved in the opening manipulation direction, there is no possibility that the door 1 is opened.

The locking lever 36 at the unlocking position is rotated in the −Z direction toward the locking position. With the rotation of the locking lever 36, a component force in the +X direction is generated in the direction toward the second arm portion 51 due to the inclination of the inclined portion 68. When the generated component force exceeds a biasing force in the −X direction applied to the second arm portion 51, a state is brought about where the second arm portion 51 is moved from the second holding portion 63 to the first holding portion 62 along the inclination of the restricting portion 68. With such movement of the second arm portion 51, the second arm portion 51 is returned to a state where the second arm portion 51 is held on the first holding portion 62.

In the door locking device 10 of the second embodiment, in the same manner as the first embodiment, when the locking mechanism 25 performs a normal switching operation, a state where the second arm portion 51 is held on the first holding portion 62 can be maintained. When an impact is applied to the door 1 so that a force of inertia equal to or more than a set value acts on the link 27, the link 27 can be moved to the operating position against a biasing force of the spring member 48. The second arm portion 51 moved to the operating position can be held at the operating position (locking position) by the restricting portion 68. Further, when the locking mechanism 25 is moved from the unlocking position to the locking position, the link 27 can be returned to the initial position. Accordingly, the second embodiment can acquire substantially the same advantageous effect as the first embodiment.

The door locking device 10 of the present invention is not limited to the configurations of the above-mentioned embodiments, and various modifications are conceivable.

For example, the link 27 may be biased toward the initial position by locking the second arm portion 51 to an edge of the connecting portion 29 on the operating position side. Also with such a configuration, the link 27 is sandwiched between the second arm portion 51 and the stopper portion so that movement of the link 27 in the advancing and retracting direction is guided. It is sufficient for the restricting portion to adopt a configuration where the restricting portion can lock the spring member moved to the operating position.

What is claimed is:

1. A door locking device comprising:

a latch mechanism detachably engageable with a striker and having a manipulation receiving portion for releasing engagement of the latch mechanism with the striker;

an opening lever interlockingly rotatable with a manipulation of a door handle;

a transmission member configured to swing between an initial position, in which a rotational force of the opening lever is transmittable to the manipulation receiving portion, and operating position, in which the rotational force of the opening lever is not transmittable to the manipulation receiving portion;

a spring member configured to bias the transmission member to swing from the operating position toward the initial position, and to allow the transmission member to swing from the initial position toward the operating position when a force of inertia equal to or more than a set value acts on the transmission member; and a restricting portion configured such that the spring member, which moves with a swinging of the transmission member, is directly engaged to the restricting portion when the transmission member is swung to the operating position against a biasing force of the spring member due to an action of the force of inertia equal to or more than the set value, thus restricting biasing of the transmission member to swing toward the initial position by the spring member.

2. The door locking device according to claim 1, further comprising a locking lever configured to rotate between an unlocking position and a locking position, wherein the spring member is arranged on the locking lever, and the locking lever is configured to swing the transmission member to the initial position and the operating position, wherein the spring member comprises:

a first arm portion fixed to the locking lever; and a second arm portion configured to bias the transmission member to swing toward the initial position on an unlocking position side of the locking lever, and is configured to allow the transmission member to swing toward the operating position on a locking position side of the locking lever when the force of inertia equal to or more than the set value acts on the transmission member, and the restricting portion is disposed at a position where the second arm portion is lockable to the restricting portion in a state in which the locking lever is in the unlocking position, and the transmission member has been swung to the operating position due to the action of the force of inertia equal to or more than the set value.

3. The door locking device according to claim 2, wherein the transmission member has a guide hole extending in a direction along which the transmission member advances and retracts due to rotation of the opening lever, and the spring member has a guide projecting portion, inserted into the guide hole, at a distal end of the second arm portion.

4. The door locking device according to claim 2, wherein the restricting portion is arranged on an arrangement surface of a base member where the locking lever and the transmission member are arranged, the second arm portion of the spring member is biased toward the arrangement surface, and the locking lever includes a first holding portion, which holds the second arm portion at a position where the second arm portion is not lockable to the restricting portion, and a second holding portion, which holds the second arm portion at a position where the second arm portion is lockable to the restricting portion.

5. The door locking device according to claim 3, wherein the restricting portion is arranged on an arrangement surface of a base member where the locking lever and the transmission member are arranged, the second arm portion of the spring member is biased toward the arrangement surface, and the locking lever includes a first holding portion, which holds the second arm portion at a position where the second arm portion is not lockable to the restricting portion, and a second holding portion, which holds the second arm portion at a position where the second arm portion is lockable to the restricting portion.

6. The door locking device according to claim 4, wherein the locking lever includes a guide portion for guiding the second arm portion from the first holding portion to the second holding portion in a state in which the transmission member is swung from the initial position toward the operating position due to the action of the force of inertia equal to or more than the set value.

7. The door locking device according to claim 5, wherein the locking lever includes a guide portion for guiding the second arm portion from the first holding portion to the second holding portion in a state in which the transmission member is swung from the initial position toward the operating position due to the action of the force of inertia equal to or more than the set value.

8. The door locking device according to claim 4, wherein the locking lever includes a contact portion which is brought into contact with the second arm portion, due to rotation of the locking lever in a direction from the unlocking position to the locking position, so as to release locking between the second arm portion and the restricting portion.

9. The door locking device according to claim 5, wherein the locking lever includes a contact portion which is brought into contact with the second arm portion, due to rotation of the locking lever in a direction from the unlocking position to the locking position, so as to release locking between the second arm portion and the restricting portion.

10. The door locking device according to claim 6, wherein the locking lever includes a contact portion which is brought into contact with the second arm portion, due to rotation of the locking lever in a direction from the unlocking position to the locking position, so as to release locking between the second arm portion and the restricting portion.

11. The door locking device according to claim 7, wherein the locking lever includes a contact portion which is brought into contact with the second arm portion, due to rotation of the locking lever in a direction from the unlocking position to the locking position, so as to release locking between the second arm portion and the restricting portion.

12. The door locking device according to claim 2, wherein the restricting portion is formed on the locking lever.

13. The door locking device according to claim 3, wherein the restricting portion is formed on the locking lever.

14. The door locking device according to claim 1, wherein the transmission member is a mass body made of a metal material.

* * * * *